United States Patent [19]

Hood

[11] 4,004,384

[45] Jan. 25, 1977

[54] STAIRWAY UNIT

[75] Inventor: Murray C. Hood, Oakland, Calif.

[73] Assignee: Curoco, Albany, Calif.

[22] Filed: Feb. 6, 1976

[21] Appl. No.: 655,961

[52] U.S. Cl. ..... 52/188

[51] Int. Cl.[2] ..... E04F 11/12

[58] Field of Search ..... 52/182, 184, 185, 188, 52/191

[56] References Cited

UNITED STATES PATENTS

| | | | |
|---|---|---|---|
| 2,193,146 | 3/1940 | Skeel | 52/191 |
| 2,205,859 | 6/1940 | O'Donnell | 52/188 |
| 2,377,994 | 6/1945 | Cocken | 52/182 |
| 3,257,761 | 6/1966 | Klein | 52/191 |
| 3,839,840 | 10/1974 | Miller | 52/188 |

*Primary Examiner*—John E. Murtagh
*Attorney, Agent, or Firm*—James R. Cypher

[57] ABSTRACT

A stairway unit for a multi-level construction including briefly: a one-piece metal member forming both treads and risers, parallel metal stringer members each presenting a vertical planar side to the one-piece metal member; and the edges only of the one-piece metal member being connected to the stringers as by welding. No additional tread members are required and the stairway may be used as is, or with the addition of pads and carpeting to the treads and/or risers or with other suitable covers.

3 Claims, 17 Drawing Figures

STAIRWAY UNIT

BACKGROUND OF THE INVENTION

Stairways are as old as architecture itself. The design has seen practically no change since Sir Henry Wotton, a 17th Century English diplomat and writer included architecture among his interests and offered his strictures on the construction of stairs.

For several hundred years, stairways were constructed by joining a plurality of individual treads and a plurality of individual risers to separate stringers. In the early 1940's O'Donnell in U.S. Pat. No. 2,205,859 formed treads and risers with an intervening chamfer from one piece of metal. One form of the O'Donnell stairway, however, required the use of separate tread members having considerable thickness to eliminate part or all of the chamfer space between the tread and the next riser. Further, all forms of the O'Donnell stairway required a special Z-shaped stringer so that the one-piece member could be attached to the stringer. The use of the special Z-shape with its inturned flange severely limited the type of metal stringer that could be used. Thus, use of the stairway in one-supporting wall constructions or stairways requiring integral free-standing handrails was difficult or prohibitively costly.

SUMMARY OF THE INVENTION

The gist of the present invention is the use of a one-piece sheet metal member which forms both the treads and the risers and is connected at its edges only to the vertical face of parallel stringers.

An object of the present invention is to provide a unit stairway which can be produced more inexpensively at a factory location and then quickly installed at the job site.

Another object is to provide a stairway which requires a minimum of parts.

A further object is to provide a unit stairway which can be located against one wall, between two walls or free standing.

A still further object is to provide a stairway which can be constructed with integral railings on one or both sides.

Still another object is to provide a stairway structure which is lighter than other comparable stairways.

BRIEF DESCRIPTION OF THE PREFERRED EMBODIMENTS OF THE INVENTION

Figure 1:
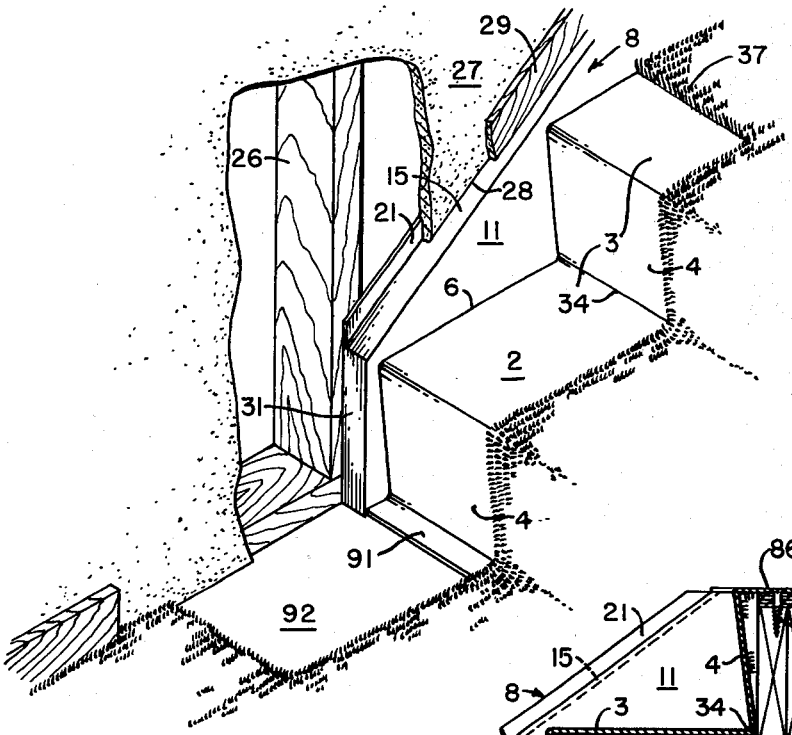
FIG. 1 is a perspective view of a portion of the stairway of the present invention shown in a typical construction with portions of the construction broken away for purposes of illustration.

The stairway unit of the present invention consists briefly of a single sheet metal member 2 forming the treads 3 and risers 4 and having parallel side edges 6 and 7; a pair of stringers 8 and 9 each having planar, vertical-face sides 11 and 12; and the sheet metal member is connected at its edges only to the vertical faces of the stringers as by welds 13.

The sheet metal member is preferably made from steel sheet having a thickness, e.g. of 0.074 inch or 14 gauge. Dimensions of the treads and risers may vary. Typically, a tread depth of 10 inches may be used. Risers vary with the floor to floor height. For a height of 8 feet - 9 inches, 14 risers of 7½ inches may be used. For a height of 8 feet - 11 inches, 14 risers of 7.64 inches may be used. With a height of 9 feet - 1 inch, 14 risers of 7 13/16 inches may be used. Preferably, the riser is not vertical, but rather is slanted toward the rear of the tread a distance of 1 inch.

Since the edges of the sheet metal member are connected to the planar vertical faces of the stringers, the cross-sectional shape of the stringers may be formed in various shapes. One shape which gives the unit the necessary rigidity at a minimum cost is a "hat shape" including: a pair of laterally projecting sides 15 and 16 for stringer 8 and sides 18 and 19 for stringer 9, integrally connected to the vertical face sides; and vertical flanges 21, 22, 23 and 24 integrally connected to the respective ends of the laterally projecting sides.

A typical stringer may be formed from steel having a thickness of 0.074 inch or 14 gauge. The vertical side may have a length of 8 inches; the side 1½ inches and the flange a length of ¾ inch. Dimensions will vary with the parameters of the installation.

A typical installation of the stairway in a wood frame building construction is shown in FIG. 1.

Figure 12:
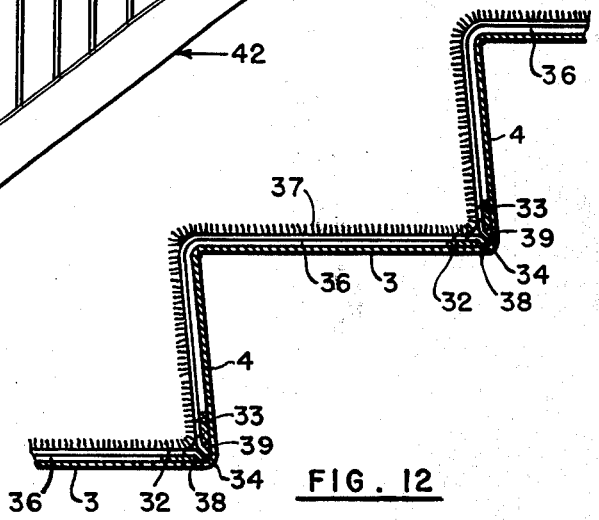
FIG. 12 is an enlarged cross-sectional view of a portion of the stairway shown in FIG. 2 with a carpet and pad added.

The stringer flanges are placed flush with the studs 26 and the gypsum or other type wall board 27 is attached to the studs with its bottom edge 28 overlapping the stringer flange and resting on the stringer side 15. A molding 29 such as a wood strip is placed on the stringer side against the wall board to cover the edge 28 of the wall board. To give a finished appearance to the unit, a cover plate 31 may be welded to the bottom edge of the stringer. As shown in FIGS. 1 and 12, a pad 36 and carpet 37 may cover the metal stairway without the necessity of additional tread members. Tack strips 32 and 33 are attached to the stairway by contact cement at the bend line 34 between the tread and riser at the base of the riser. Pads 36 are then attached directly to the metal member by a latex multipurpose adhesive. The carpet 37 is then attached to the nailing strips and the spade ends 38 and 39 are placed between the carpet tack strips.

Referring to FIGS. 9, 10, 11, 13, 14, 16 and 17, another form of stringer is shown. Where one or both of the sides of the stairs is open, a "box" or tube stringer 41 and 42 is used on the open side. Stringer 41 includes parallel vertical sides 43 and 44 which are joined by upper-and lower-side members 46 and 47. In like manner, stringer 42 includes parallel vertical sides 48 and 49 which are joined by upper-and lower-side members 51 and 52. A typical tube stringer may be 2 inches × 8 inches.

Figure 9:
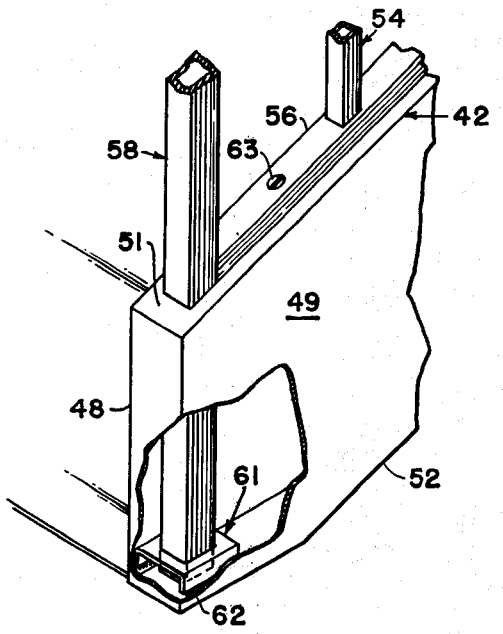
FIG. 9 is a perspective view of a modified form of the invention showing the connection of an end post and a picket to the stairway stringer.
Figure 11:
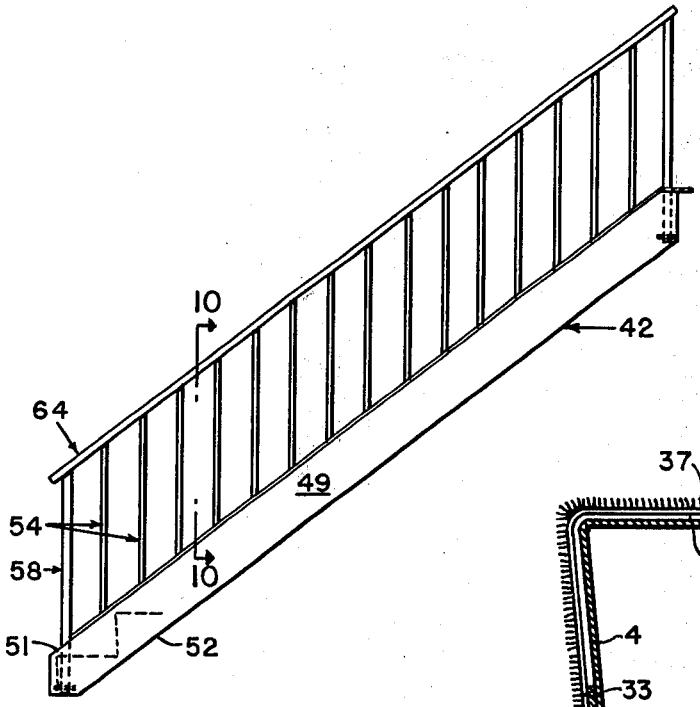
FIG. 11 is a side view of a modified form of the stairway unit.

The advantage of connecting the edges of the single sheet metal member 2 forming the treads and risers to the vertical side walls of the stringers becomes apparent when the problem of providing stair railings is reached. As set forth above, a simple box stringer may be used and this enables easy attachment of railings. Referring to FIGS. 9, 10, 16 and 17, the railing is attached to the stringers in the following manner. A plurality of tube pickets 54 are inserted into an opening in a channel member 56 and attached as by a concealed weld 57 on the underside of the channel. End posts 58 such as the one shown in FIG. 9 are inserted through an opening in the upper-side member 51 of the stringer and extend to the lower-side member 52 of the stringer. A clip 61 with an opening therethrough receives the end of the post. The clip may be attached to the stringer, as by weld 62.

Figure 10:
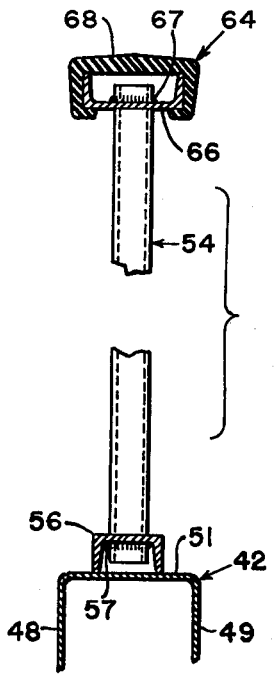
FIG. 10 is a cross-sectional view of the stairway shown in FIG. 11 taken along line 10—10.

The channel member is connected to the stringer by metal screws 63. A typical tube picket may be constructed from 0.062 inch metal ½ × ½ inch. The rolled channel may be ½ × 1 inch. The tube post is preferably 0.095 inch thick and 1 × 1 inch in cross section. The hand railing 64 is shown in FIG. 10. A rolled channel member 66½ × 1½ inches is attached to the tube pickets and posts by inserting their ends through openings in the channel and welding along lines 67. A rubber or other elastomeric member 68 is attached to the channel 67 to complete the hand railing.

Figure 6:
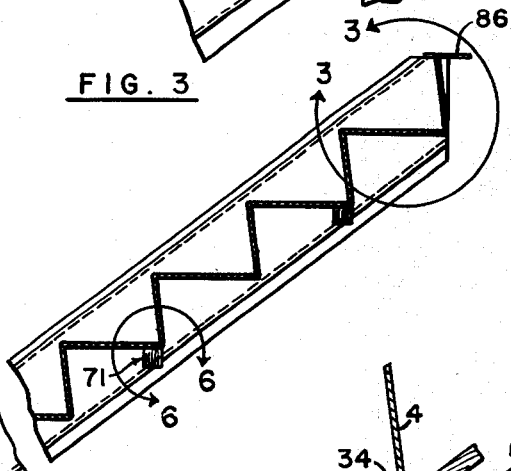
FIG. 6 is an enlarged cross-sectional view of the invention shown in FIG. 2 taken along line 6—6.
Figure 2:
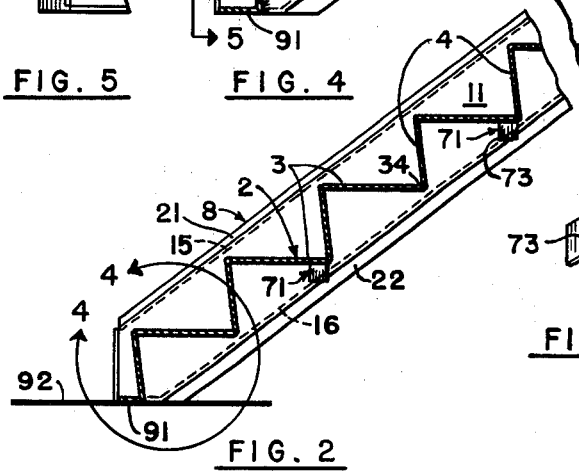
FIG. 2 is a cross section of the stairway of the present invention.
Figure 7:
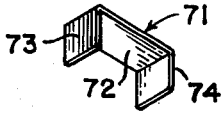
FIG. 7 is a perspective view of the clip shown in FIGS. 2 and 6.
Figure 8:
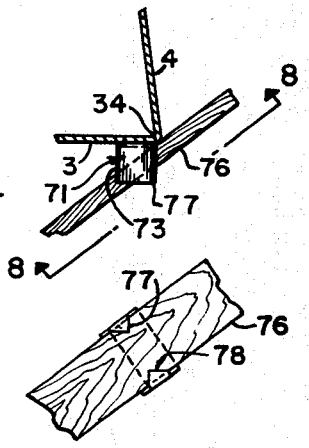
FIG. 8 is a bottom plan view of the clip shown in FIGS. 2, 6 and 7 bent to hold the furring strip.

Referring to FIGS. 2, 6, 7, and 8, the structure for enabling gypsum board to be installed on the underside of the stair unit is shown. A plurality of axially aligned channel-shaped brackets 71 are connected to the underside of the treads. Each bracket is formed with a laterally extending base 72. The bracket base is connected to the underside of the treads. Integrally connected downwardly extending flanges 73 and 74 are adapted for bendably engaging a furring strip 76. As shown in FIGS. 6 and 8, tips 77 and 78 are bent to engage the lower side of the furring strip. The bracket may be 18 gauge and of sufficient dimensions to hold a 1 × 4 inch furring strip as described.

Figure 15:
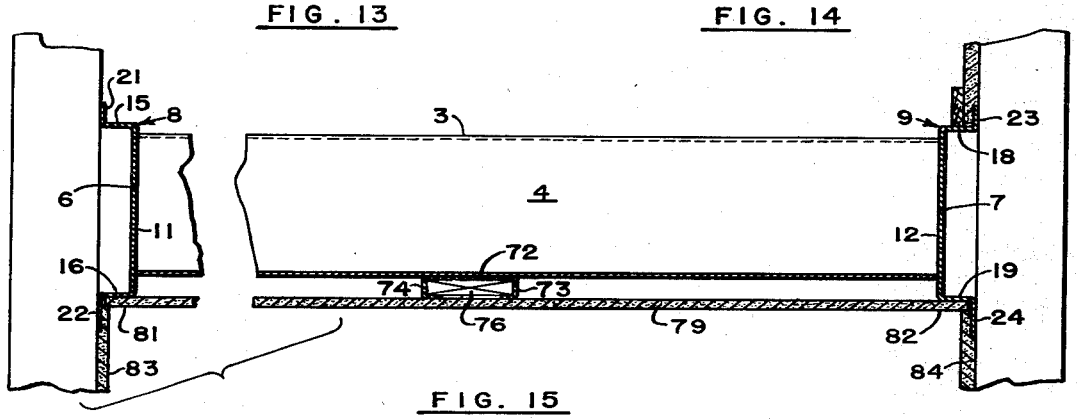
FIG. 15 is an enlarged cross section of the stairway of FIG. 14 taken generally along line 15—15.

Referring to FIG. 15, a typical installation is shown with the gypsum board soffit attached to the underside of the stair unit. After the furring piece is placed in the channel members 71 and the tips bent over with a hammer, a gypsum board soffit member 79 is attached to the furring member by nails or screws. The ends 81 and 82 of the gypsum board extend to the undersides of sides 16 and 19 of the stringer members. Side gypsum board members 83 and 84 are placed flush to flanges 22 and 24 and hold the underside of gypsum board soffit member 79.

Figure 16:
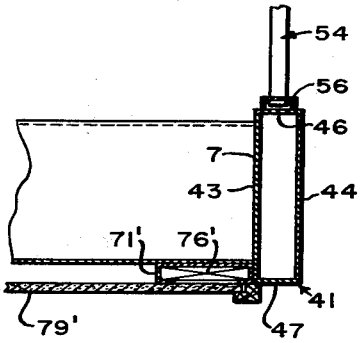
FIG. 16 is an enlarged cross section of the stairway shown in FIG. 14 taken along line 16—16.

FIG. 16 shows a modified form of the invention with the bracket 71' connected to furring strip 76' at the side of the stair tread. Gypsum board soffit member 79' is connected to the furring strip.

Figure 17:
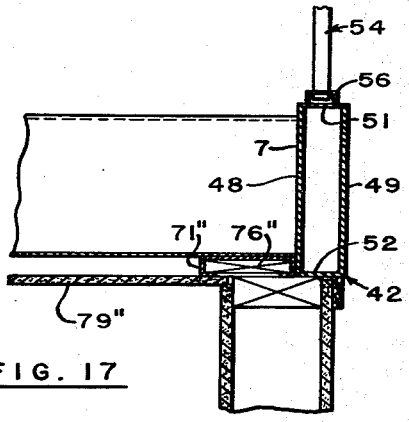
FIG. 17 is an enlarged cross section of a portion of the stairway shown in FIG. 14 taken along line 17—17.

FIG. 17 shows another modified form of the invention with the bracket 71'' connected to furring strip 76'' also at the side of the stair tread. Gypsum board soffit member 79'' is connected to the furring strip.

Figure 3:
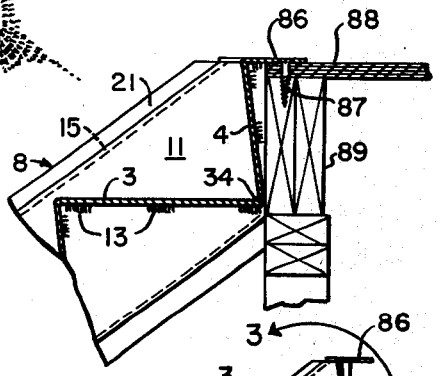
FIG. 3 is an enlarged cross-sectional view of the invention shown in FIG. 2 taken generally in the area of line 3—3. Portions of the construction framing and flooring are shown in cross section.
Figure 5:
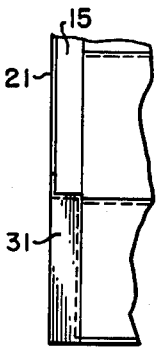
FIG. 5 is a front view of the portion of the stairway shown in FIG. 4 taken along line 5—5.
Figure 4:
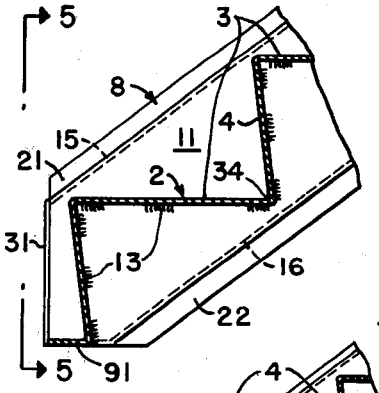
FIG. 4 is an enlarged cross-sectional view of the invention shown in FIG. 2 taken generally in the area of line 4—4.
Figure 13:
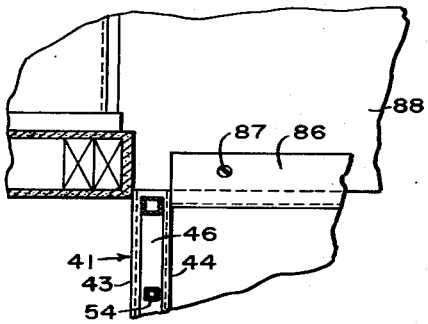
FIG. 13 is an enlarged plan view of a portion of the stairway shown in FIG. 14 taken along line 13—13.
Figure 14:
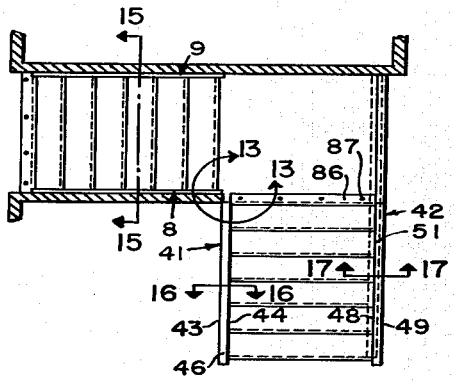
FIG. 14 is a top plan view of a portion of the stairway of the present invention. Portions of the building construction are shown in cross section.

Problems of unequal expansion of the metal stairs in regard to the wooden structure are solved by attaching the stair unit only at its upper end as shown in FIGS. 3, 13 and 14. The uppermost partial tread 86 is formed with openings, and screws 87 are inserted therethrough to the floor member 88 and joist 89. The lower-most tread 91 rests upon the floor 92 and slides thereon as expansion and contraction of the stair unit occurs with changes in temperature.

I claim:

1. A stairway unit comprising:

a. a single sheet metal member forming the treads and risers and having parallel side edges;

b. a pair of stringers each having a planar, vertical-face side;

c. said sheet metal member being connected at its edges only to the vertical-face sides of said stringers; and d. a plurality of axially aligned channel-shaped brackets connected to the underside of a plurality of said treads having a laterally extending base joined on their outer sides to said treads and integrally connected downwardly extending flanges adapted for bendably engaging a furring strip.

2. A stairway unit comprising:

a. a single sheet metal member forming the treads and risers and having parallel side edges;

b. a pair of stringers each having a planar, vertical-face side;

c. said sheet metal member being connected at its edges only to the vertical-face sides of said stringers;

d. one of said stringers is shaped in the form of an elongated box including a pair of parallel vertical sides integrally joined by upper and lower end members;

e. a plurality of tube pickets connected at their upper ends to a railing;

f. a rolled channel member connected to the upper side of said stringer and formed with a plurality of openings for attachably receiving the lower ends of said pickets;

g. end posts connected at their upper ends to said railing and having a length extending through said upper end member to approximately said lower end member, and h. clip members connected to said stringer and laterally engaging said lower ends of said posts.

3. A stairway unit comprising:

a. a single sheet metal member forming the treads and risers and having parallel side edges;

b. a pair of stringers each having a planar, vertical-face side;

c. said sheet metal member being connected at its edges only to the vertical-face sides of said stringers; and d. said uppermost tread member is adapted to rest upon the floor of an upper landing and is attached thereto to prevent relative movement therebetween; and e. said lowermost tread member is adapted to rest upon the floor of a lower land and is free to slide thereupon.

* * * * *